US006668871B1

(12) United States Patent
Bundy

(10) Patent No.: US 6,668,871 B1
(45) Date of Patent: Dec. 30, 2003

(54) WIRE WEAVING APPARATUS AND METHOD

(76) Inventor: William J. Bundy, 736 Eddy Rd., Crownsville, MD (US) 21032-1719

( * ) Notice: Subject to any disclaimer, the term of this patent is extended or adjusted under 35 U.S.C. 154(b) by 0 days.

(21) Appl. No.: 09/910,409

(22) Filed: Jul. 23, 2001

(51) Int. Cl.[7] ..... B21F 27/02

(52) U.S. Cl. ..... 140/123; 140/71 R; 63/37

(58) Field of Search ..... 66/1 A, 2; 87/34, 87/6, 35, 13, 62, 11; 139/380, 425 R; 140/52, 71 R, 92.1, 123; 269/3, 4, 5, 6, 43, 44; 63/37; 220/493; D11/131, 157; 245/1

(56) References Cited

U.S. PATENT DOCUMENTS

| | | | | | |
|---|---|---|---|---|---|
| 113,779 A | * | 4/1871 | Latham | 140/71 R |
| 692,404 A | * | 2/1902 | Wright | 245/1 |
| 751,518 A | | 2/1904 | Killion | |
| 1,180,710 A | * | 4/1916 | Geer | 140/71 R |
| 1,219,622 A | * | 3/1917 | Brooks | 140/71 R |
| 1,499,769 A | | 7/1924 | Godefroy | |
| 1,771,278 A | | 7/1930 | Weiner | |
| 1,881,659 A | * | 10/1932 | Kellems | 140/92.1 |
| 3,526,103 A | | 9/1970 | Lieber | |
| 4,219,959 A | | 9/1980 | Fleischer | |
| 5,112,268 A | | 5/1992 | Klaus | |
| 5,853,033 A | * | 12/1998 | Kavanagh | 140/123 |

* cited by examiner

*Primary Examiner*—Lowell A. Larson
(74) *Attorney, Agent, or Firm*—Salzman & Levy

(57) ABSTRACT

A unique wire weaving method using a new wire weaving tool that holds a multiplicity of wires in place during the weaving process. The tool includes a shaft supporting a head with a plurality of wire receiving holes disposed substantially equally thereabout. Normally, a multiplicity of metal wires form a dangling, unwieldy mass of threads and strings, which hamper the weaving process. The present tool allows the wires to be held to the shaft of the tool after they have been bent inwardly from the head, thus locking them in place about the shaft.

15 Claims, 5 Drawing Sheets

WIRE WEAVING APPARATUS AND METHOD

FIELD OF THE INVENTION

The present invention relates to wire weaving tools and methods and, more particularly, to a wire weaving tool and technique for holding a multiplicity of wire pieces securely in place during a wire weaving operation.

BACKGROUND OF THE INVENTION

The art of wire weaving and wire forming has generally utilized hand techniques for fabricating flat pads and padding for chair seat frames, fabric-like materials for beadwork, and twisted wire in the fabrication of decorative jewelry and toys. Depending upon the value of the components (e.g., beads, precious gems) used in the manufacture of the article, of course, the finished product may have substantial value.

Some of the more common techniques for using wire as a decorative article material are illustrated in United States Patents. U.S. Pat. No. 751,518 was issued to J. H. Killion on Feb. 9, 1904 for STOCK FOR FRAMING OR OTHER PURPOSES. U.S. Pat. No. 1,499,769 was issued to M. Godefroy on Jul. 1, 1924 for FABRICATED BEADWORK. U.S. Pat. No. 1,771,278 was issued to A. Weiner on Jul. 22, 1930 for ORNAMENTING DEVICE AND METHOD OF MAKING THE SAME. U.S. Pat. No. 3,526,103 was issued to J. G. Lieber on Sep. 1, 1970 for WIRE AND BEAD JEWELRY CONSTRUCTION. U.S. Pat. No. 5,112,268 was issued to Kathy Klaus on May 12, 1992 for BEADS AND WIRE FRAME TOY.

Wire weaving and wire forming are generally arts that do not rely upon any special tooling or unusual techniques for fabricating articles. Rather, the wire weaving and forming arts have generally relied upon the imagination of creative artists to fashion their creations using ordinary tools and utensils.

Egg ornaments and toys have always fascinated the public, dating back at least to the famous Fabrege eggs that were created for the Romanoffs. Eggs are one of the most perfect shapes and have a pleasing aura. Unfortunately, however, creating hollow eggs from wire is not a trivial process. An unusual toy creation in the form of an egg, fashioned from interleaved and intertwined helix shells, is illustrated in U.S. Pat. No. 4,219,959, issued to Fleischer on Sep. 2, 1980, entitled TOY EGG.

The present invention meets a desire to create eggs that are fabricated by the weaving of a multiplicity of wires. In order to accomplish the weaving of wires that form the eggs of this invention, it is necessary to hold the many wires in place during the weaving process. Since ordinary looms and pegboards cannot be used to weave the egg shape, it was necessary to generate a new weaving tool and technique to create the egg.

The current invention comprises a new wire weaving technique and tool. The tool comprises a spindle or mandrel-type device, having a substantially circular head portion disposed on a distal end of an elongated shaft forming a handle portion. The head contains a plurality of substantially equally spaced holes. Each of the holes in the head receives an individual wire that is respectively threaded through the head portion and then bent inwardly toward the handle.

Owing to the unwieldy nature of many wires dangling from the head, it is necessary to affix the wires to the handle.

Several bands wrap about the wires and affix them to the shaft. Simple rubber bands can be used for this purpose. The wires are prevented from shifting or working loose with respect to their position about the head since they take a sharp bend toward the handle after passing through the holes in the head portion. The firmly held wires can then be weaved easily in decorative articles, such as eggs.

SUMMARY OF THE INVENTION

In accordance with the present invention, there is provided a wire weaving tool and technique for fabricating decorative and useful wire-woven articles. The tool consists of a mandrel having a substantially circular head portion disposed on a distal end of an elongated shaft. The head contains a plurality of substantially equally spaced holes. Each of the holes in the head receives an individual wire that is respectively threaded through the head and then bent inwardly toward the shaft. Owing to the unwieldy nature of many wires dangling from the head, the wires are affixed to the shaft by several bands that wrap about the wires. Simple rubber bands can be used for this purpose. The wires are prevented from shifting or working loose with respect to their position about the head, due to a sharp bend of wires toward the shaft after passing through the holes. The firmly held wires can then be weaved easily in decorative articles of any regular or irregular substantially hollow shape, preferably an egg. The shape can have a flat bottom surface allowing the object to stand on its own accord.

Once the weave is substantially established, a shaping block can be placed on top of the tool to complete the weaving of the article. The shaping block is used as a guide to direct the weaver to form the wire into the desired decorative article.

The wire-woven article can also act as a method of dissipating energy and dampening vibration for diverse equipment. By using the woven wire to dissipate energy, each wire acts independently from every other. The total number of wires multiplies the individual action of each wire such that the total forces that can be dissipated are much greater than that of other methods. Additionally, the hollow design of the inventive wire-woven article enables it to be lighter in weight than other devices currently in use. The shape of the inventive article is maintained while dissipating energy and dampening vibration.

It is an object of this invention to provide an improved wire weaving tool and method.

It is another object of the present invention to provide a wire weaving tool that can hold in place a multiplicity of wires as they are formed into a decorative article.

It is yet another object of the present invention to provide a woven wire article that can be used to dissipate energy and dampen vibration.

BRIEF DESCRIPTION OF THE DRAWINGS

A complete understanding of the present invention may be obtained by reference to the accompanying drawings when considered in conjunction with the subsequent detailed description in which.

For purposes of brevity and clarity, like elements and components will bear the same designations and numbering throughout the figures.

DESCRIPTION OF THE PREFERRED EMBODIMENT

Generally speaking, this invention is related to a unique wire weaving method using a new wire weaving tool that holds a multiplicity of wires in place during the weaving process. The tool comprises a shaft supporting a head with a plurality of wire receiving holes disposed substantially equally thereabout. Normally, a multiplicity of metal wires form a dangling, unwieldy mass of threads and strings, which hamper the weaving process. The present tool allows the wires to be held to the shaft of the tool after they have been bent inwardly from the head, thus locking them in place about the shaft.

Figure 1C:
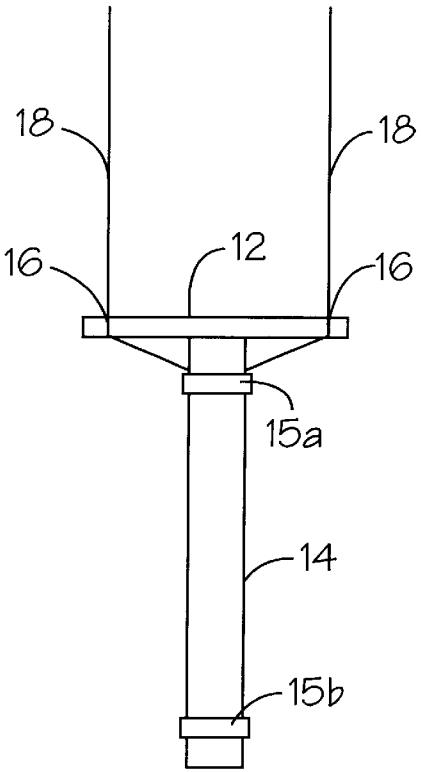
FIG. 1*c* depicts the tool shown in FIG. 1*a* with wires ready for weaving.
Figure 1B:
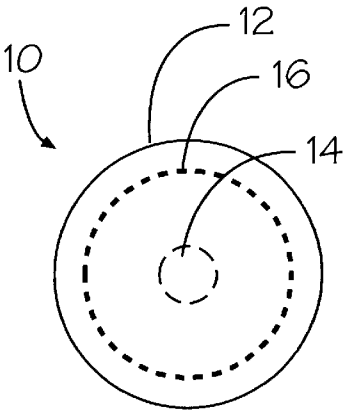
FIGS. 1*a* and 1*b* illustrate front and top views, respectively, of a wire weaving tool in accordance with the present invention.
Figure 1A:
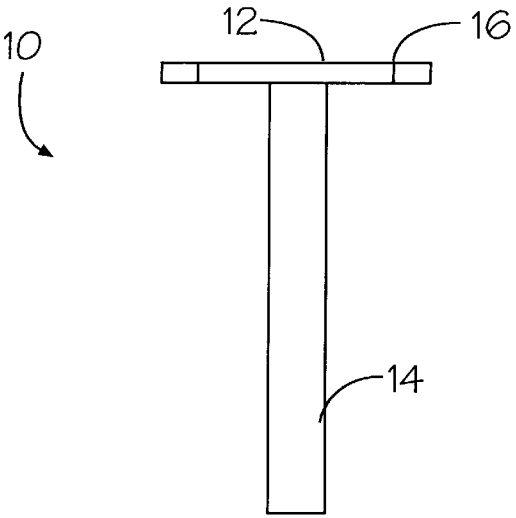

Now referring to FIGS. 1*a* and 1*b*, there is shown a wire weaving tool 10 in accordance with the present invention. The tool 10 comprises a circular head portion 12 disposed on top of a shaft-like handle 14. The circular head portion 12 comprises a plurality of threading holes 16 that receive a multiplicity of wires 18, as shown in FIG. 1*c*. The wires 18 are threaded through the holes 16 and are then bent inwardly toward the shaft 14. The multiplicity of wires 18 are made to run down the length of the shaft 14 where they are affixed to the shaft 14 by two, upper and lower rubber bands 15*a* and 15*b*, respectively.

Figure 2:
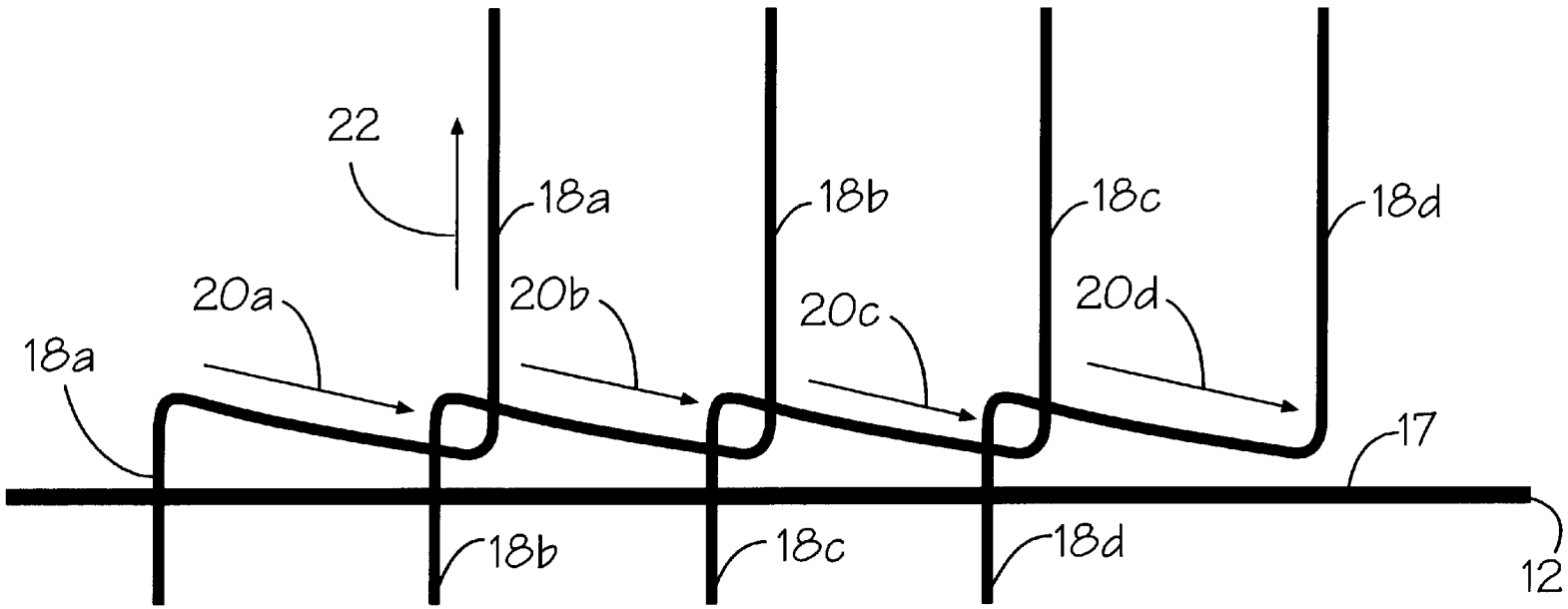
FIG. 2 shows an enlarged view of a first row of wires disposed on the head of the tool depicted in FIG. 1*c;*

Referring to FIG. 2, the wire weaving method of this invention is shown. The left hand wire 18*a* projecting from the top face 17 of the head 12 of tool 10 is caused to be bent towards the right (arrow 20*a*). As the wire 18*a* is bent towards the right, it encounters adjacent wire 18*b*, at which point it is bent upwardly, as illustrated by arrow 22. Thus, wire 18*a* uses wire 18*b* as a pivot when it is caused to be bent upwardly. Wire 18*b* is then bent towards the right (arrow 20*b*) where it encounters adjacent wire 18*c*, and is pivotally directed upwardly, as was the wire 18*a* before it.

As the weaver works his or her way around the circular head 12, each wire 18*a* –18*d*, etc. in turn is caused to be bent towards the right and then upwardly about its adjacent wire. The process is repeated until beginning wire 18*a* is reached. At this point in the process, the last wire 18 is tucked under the first wire 18*a* , completing the first woven row of a woven wire article. By building one row upon another row, a woven wire article is created using the tool 10 illustrated in FIGS. 1*a* through 1*c*, and pursuant to the method shown in FIG. 2. Beads 13 are threaded on each wire 18 for every row, resulting in a colorful pattern of colors and shapes.

The tool 10 comprises a spindle or mandrel-type device, as aforementioned, having a substantially circular head portion 12 disposed on a distal end of an elongated shaft forming a handle portion 14. The head 12 contains a plurality of substantially equally spaced threading holes 16. Each of the holes 16 in the head 12 receives an individual wire 18 that is respectively threaded through the head portion 12 and then bent downwardly about the handle 14. Owing to the unwieldy nature of many wires 18 dangling from the head 12, it is necessary to affix the wires 18 to the handle 14 by several bands 15*a*, 15*b* that wrap about the wires 18 and affix them to the shaft 14. Simple rubber bands 15*a*, 15*b* can be used for this purpose. The wires 18 are prevented from shifting or working loose with respect to their position about the head 12 due to the fact that they take a sharp bend toward the handle 14 after passing through the threading holes 16 in the head portion 12. The firmly held wires can then be weaved easily in decorative articles of any substantially hollow regular or irregular shape, including a woven wire egg, fruit or vegetable (not shown). The shape can have a flat bottom surface allowing the object to stand on its own accord. The artist weaver can add decorative beads to each wire 18 as each row is strung, in order to provide aesthetic character to the weave. A half-dome member (not shown) can be placed on top of the circular head 12 at surface 17 to guide the weaving of the egg.

Figure 3:
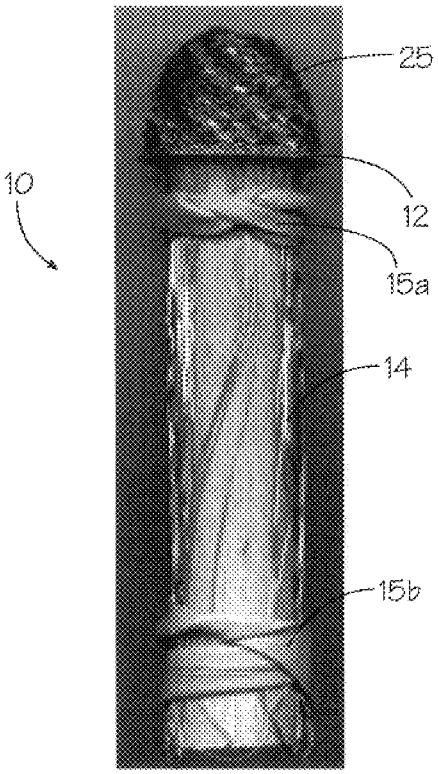
FIG. 3 illustrates a perspective, frontal view of an egg article that has been partially weaved upon the tool depicted in FIGS. 1*a* through 1*c;*
Figure 4:
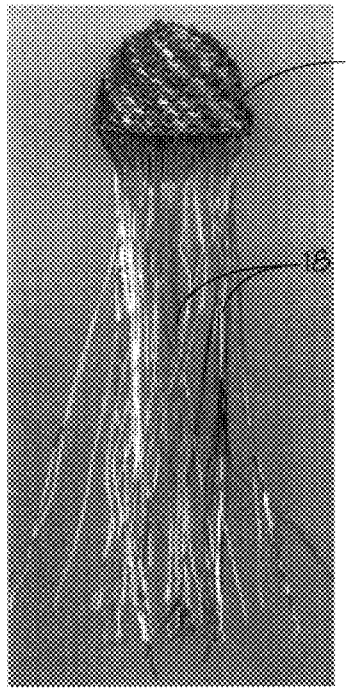
FIG. 4 shows a front view of the egg of FIG. 3 removed from the head of the tool depicted in FIGS. 1*a* through 1*c;*
Figure 5:
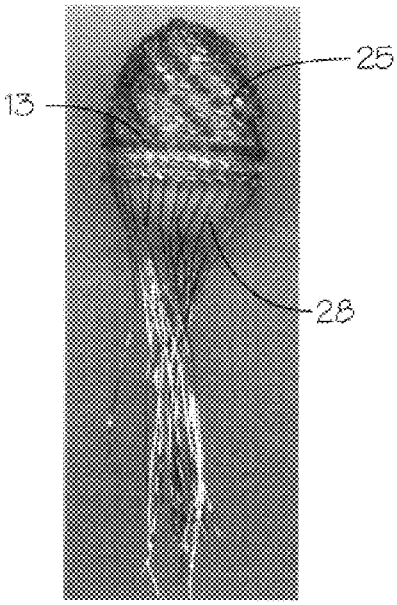
FIG. 5 illustrates a front view of the egg of FIG. 4 as it is placed on a guide form.
Figure 6:
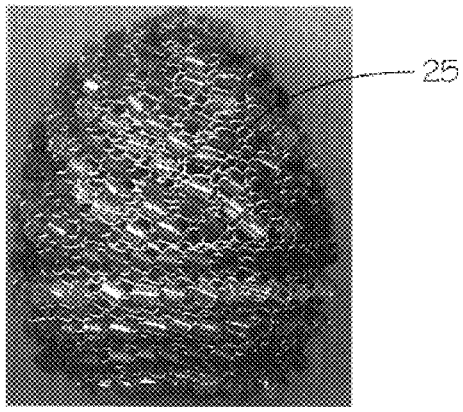
FIG. 6 depicts a front view of a woven egg fabricated in accordance with this invention.

Referring to FIG. 3, an egg 25 is shown being woven using the device 10 depicted in FIGS. 1*a* through 1*c*. In the creation of an egg 25, as shown in this figure, it is necessary to progressively reduce the number of wires 18 being woven. This is accomplished by progressively tucking a wire 18 under, after each row or after every other row, depending on the shape of the article to be formed. When the final row is reached, (i.e., the top of the egg 25 is formed, as shown in FIG. 4), the wires 18 of egg 25 can be removed from the tool 10. A half-dome member 28, as shown in FIG. 5, can be placed in the top portion of the partially completed egg 25 to provide a guide to the weaving of the bottom portion of the egg, producing the finished egg article illustrated in FIG. 6.

Using the tool 10 and processes described herein, various articles of different shape and character can be woven. The size and shape of the article influences the size and number of holes 16 that are part of tool 10.

Figure 7:
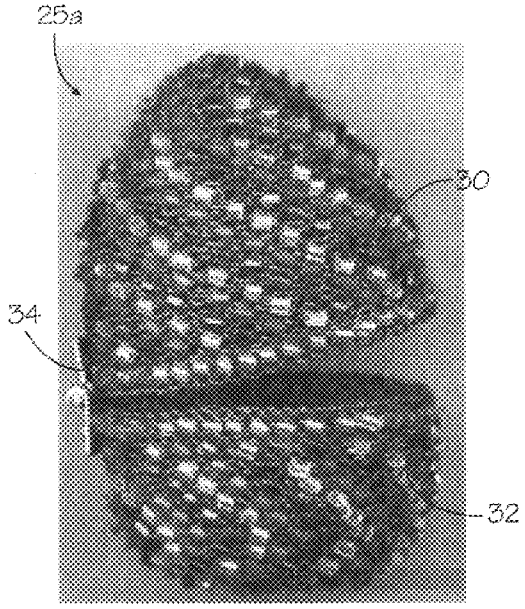
FIG. 7 shows an enlarged, side view of a wire woven egg that is hinged at a mid-portion.
Figure 8:
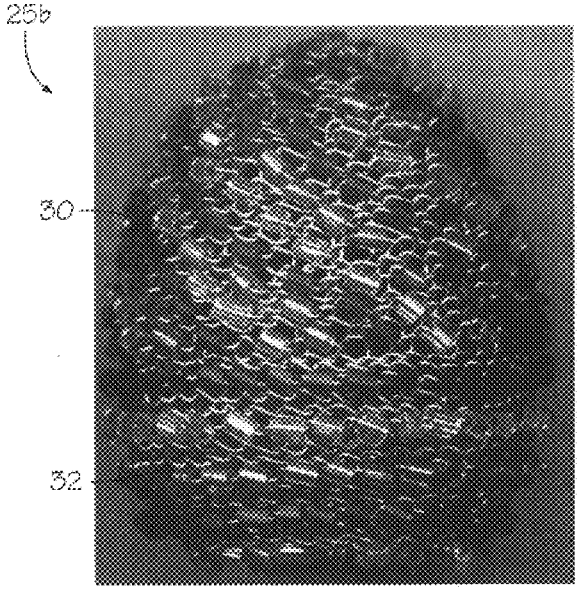
FIG. 8 illustrates an enlarged front view of the egg article of FIG. 7.

Referring to FIGS. 7 and 8, two different egg articles woven in accordance with this invention are shown. The egg 25*a* of FIG. 7 has upper and lower sections 30 and 32, respectively, which are articulated and attached together by a hinge 34. FIG. 8 shows a similar egg 25*b* whose respective upper and lower halves 30 and 32 have been woven together to form a single structured article.

The inventive article, illustrated as an egg 25, can also be used to dissipate energy and dampen vibrations. The article retains its shape when an external force is exerted onto it because of its natural energy dissipation and vibration dampening qualities.

The inventive tool can be used to create substantially hollow articles of any desired shape, depending upon the skill and creativity of the weaver.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A device for wire weaving a substantially egg-shaped article, comprising a member having means defining a plurality of holes for receiving and threading wires therethrough, said member having an elongated section upon which said wires are bent towards and affixed thereto, while said weaving is accomplished and a substantially curve-shaped section for use as a weaving guide, and for placement in a partially woven egg disposed adjacent said member, in order to complete the weaving of a remaining portion of said substantially egg-shaped article.

2. The device in accordance with claim 1, wherein said plurality of holes are substantially equally spaced about said member.

3. The device in accordance with claim 1, wherein said member is substantially circular, with said elongated section comprising a shaft extending therefrom.

4. The device in accordance with claim 3, wherein said wires are affixed to said shaft by means of at least one band.

5. The device in accordance with claim 4, wherein said at least one band is rubber.

6. A device for-wire weaving a substantially egg-shaped article, comprising a substantially flat disk-shaped member having means defining a single set of a plurality of openings therein arranged in a single circular pattern around said substantially flat disk-shaped member for receiving and threading wires therethrough, said substantially flat disk-shaped member having an elongated section extending therefrom on one side thereof, and upon which said wires are bent towards and affixed thereto, while said weaving is performed on an adjacent side of said substantially flat disk-shaped member.

7. The device in accordance with claim 6, wherein said plurality of openings are substantially equally spaced about said substantially disk-shaped member.

8. The device in accordance with claim 6, wherein said wires are affixed to said shaft by means of a pair of bands.

9. The device in accordance with claim 8, wherein said pair of bands are rubber bands.

10. A method of wire weaving an article, comprising the steps of:

a) threading a plurality of wires through holes disposed in a wire receiving member;

b) holding said wires from shifting and slipping with respect to said wire receiving member, while simultaneously weaving said plurality of wires into a wire woven article; and c) using a guide member to support a partially formed article, while completing the weaving of a remaining portion.

11. The method of wire weaving an article in accordance with claim 10, wherein said article comprises a substantially hollow shape, and selected from a group consisting of a woven wire egg, fruit, vegetable, regular object, and an irregular object.

12. The method in accordance with claim 10, further comprising the step of:

d) threading beads on at least some of said wires as said wire woven egg is created.

13. A woven wire, substantially egg-shaped article comprising a plurality of wires that are bent and linked together in a weaved pattern to form a substantially egg shape.

14. The woven wire, substantially egg-shaped article in accordance with claim 13, wherein said woven wire egg article comprises two halves that are articulated.

15. The woven wire, substantially egg-shaped article in accordance with claim 13, wherein said woven wire, substantially egg-shaped article comprises two halves that are articulated with respect to each other.

* * * * *